US011527842B2

(12) United States Patent
Lu et al.

(10) Patent No.: US 11,527,842 B2
(45) **Date of Patent: *Dec. 13, 2022**

(54) FLOATING SOCKET CONNECTOR

(71) Applicant: Molex, LLC, Lisle, IL (US)

(72) Inventors: Chiuming Lu, Lisle, IL (US); Ronald C. Hodge, Montgomery, IL (US); Pierre Perez, Aurora, IL (US)

(73) Assignee: Molex, LLC, Lisle, IL (US)

( * ) Notice: Subject to any disclaimer, the term of this patent is extended or adjusted under 35 U.S.C. 154(b) by 156 days.

This patent is subject to a terminal disclaimer.

(21) Appl. No.: 17/120,294

(22) Filed: Dec. 14, 2020

(65) Prior Publication Data

US 2021/0098916 A1 Apr. 1, 2021

Related U.S. Application Data

(63) Continuation of application No. 16/330,767, filed as application No. PCT/US2017/061910 on Nov. 16, 2017, now Pat. No. 10,892,576.
(Continued)

(51) Int. Cl.
*H01R 12/91* (2011.01)
*H01R 13/187* (2006.01)
(Continued)

(52) U.S. Cl.
CPC ..... *H01R 12/91* (2013.01); *H01R 13/187* (2013.01); *H01R 13/6315* (2013.01); *H01R 25/162* (2013.01); *H01R 12/7088* (2013.01)

(58) Field of Classification Search
CPC .. H01R 12/91; H01R 25/162; H01R 13/6315; H01R 13/187; H01R 12/7088; H01R 13/6277
See application file for complete search history.

(56) References Cited

U.S. PATENT DOCUMENTS 4,558,501 A 12/1985 Moulin et al.
D359,685 S 6/1995 Luch
(Continued)

FOREIGN PATENT DOCUMENTS

CN 1126892 A 7/1996
CN 201194295 Y 2/2009
(Continued)

OTHER PUBLICATIONS

High-current interconnect system eases PCB connections, dated Oct. 6, 2018, [online], [site visited Jul. 6, 2021], Available from Internet, URL: https://www.electronicproducts.com/high-current-interconnect-system-eases-pcb-connections/# (Year: 2018).
(Continued)

*Primary Examiner* — Oscar C Jimenez
*Assistant Examiner* — Paul D Baillargeon

(57) ABSTRACT

A socket connector is configured to mount to a component, such as a printed circuit board. The socket connector includes a base having a passageway and a channel extending outwardly from the passageway, a barrel including a wall having a flange extending outwardly therefrom, at least one biasing member engaging the flange and surrounding the wall, and a contact seated within the barrel. The wall is seated within the passageway and the flange is seated within the channel. The barrel is configured for movement within the base to align a centerline of a pin inserted into the socket connector with a centerline of the hole of the component.

52 Claims, 17 Drawing Sheets

Related U.S. Application Data

(60) Provisional application No. 62/504,827, filed on May 11, 2017, provisional application No. 62/460,323, filed on Feb. 17, 2017, provisional application No. 62/450,641, filed on Jan. 26, 2017, provisional application No. 62/428,753, filed on Dec. 1, 2016, provisional application No. 62/423,285, filed on Nov. 17, 2016.

(51) Int. Cl.

| | |
|---|---|
| ***H01R 13/631*** | (2006.01) |
| ***H01R 25/16*** | (2006.01) |
| ***H01R 12/70*** | (2011.01) |

(56) References Cited

U.S. PATENT DOCUMENTS

| | | | |
|---|---|---|---|
| 5,516,303 | A | 5/1996 | Yohn et al. |
| D391,757 | S | 3/1998 | Johnson |
| 5,769,652 | A | 6/1998 | Wider |
| 6,352,439 | B1 | 3/2002 | Stark et al. |
| 6,715,382 | B1 | 4/2004 | Hsien |
| D534,802 | S | 1/2007 | German |
| 7,422,456 | B1 | 9/2008 | Mitani et al. |
| D582,275 | S | 12/2008 | Reed et al. |
| D636,265 | S | 4/2011 | Gartner |
| D685,505 | S | 7/2013 | Yamamoto et al. |
| D723,370 | S | 3/2015 | Medlin |
| D723,919 | S | 3/2015 | Taber et al. |
| D727,152 | S | 4/2015 | Yaseen |
| 9,484,650 | B2 | 11/2016 | Shinder-Lemer et al. |
| D867,298 | S | 11/2019 | Joniak et al. |
| D868,000 | S | 11/2019 | Joniak et al. |
| D869,000 | S | 12/2019 | Sonneman |
| D875,718 | S | 2/2020 | Lee et al. |
| D877,702 | S | 3/2020 | Joniak et al. |
| D885,904 | S | 6/2020 | Kim |
| D922,199 | S | 6/2021 | Kim |
| 2001/0054531 | A1 | 12/2001 | Chang |
| 2010/0099290 | A1 | 4/2010 | Gastineau |
| 2010/0124835 | A1 | 5/2010 | Johnson |
| 2010/0186228 | A1 | 7/2010 | Montena |
| 2010/0261361 | A1 | 10/2010 | Kasparian et al. |
| 2012/0282823 | A1 | 11/2012 | Glick et al. |
| 2012/0295478 | A1 | 11/2012 | Mrowka |
| 2013/0109228 | A1 | 5/2013 | Sykes et al. |
| 2013/0109237 | A1 | 5/2013 | Glick et al. |
| 2013/0161069 | A1 | 6/2013 | Erdle et al. |
| 2014/0029900 | A1 | 1/2014 | Logan, Jr. et al. |
| 2014/0227900 | A1 | 8/2014 | Zitsch et al. |
| 2015/0126076 | A1 | 5/2015 | Horiuchi et al. |
| 2016/0141784 | A1 | 5/2016 | Hashiguchi |
| 2016/0190721 | A1 | 6/2016 | Regantini et al. |
| 2016/0332783 | A1 | 11/2016 | Kim |
| 2017/0338606 | A1 | 11/2017 | Copper et al. |
| 2018/0208333 | A1 | 7/2018 | Cesari et al. |
| 2019/0267735 | A1 | 8/2019 | Lu et al. |
| 2020/0358234 | A1 | 11/2020 | Liu et al. |

FOREIGN PATENT DOCUMENTS

| | | | |
|---|---|---|---|
| CN | 101752728 | A | 6/2010 |
| CN | 202977789 | U | 6/2013 |
| CN | 203574201 | U | 4/2014 |
| CN | 104022376 | A | 9/2014 |
| CN | 104332736 | A | 2/2015 |
| CN | 204216296 | U | 3/2015 |
| CN | 204407638 | U | 6/2015 |
| CN | 204651548 | U | 9/2015 |
| CN | 105742886 | A | 7/2016 |
| JP | S51-103267 | A | 9/1976 |
| JP | H03-118572 | U | 12/1991 |
| JP | H08-31488 | A | 2/1996 |
| JP | H11176526 | A | 7/1999 |
| JP | 2000091013 | A | 3/2000 |
| JP | 2000-182696 | A | 6/2000 |
| JP | 2004227948 | A | 8/2004 |
| JP | 2007-087682 | A | 4/2007 |
| JP | 2009230895 | A | 10/2009 |
| JP | 2010277716 | A | 12/2010 |
| JP | 2011-204607 | A | 10/2011 |
| JP | 2012014898 | A | 1/2012 |
| JP | 2014235911 | A | 12/2014 |
| JP | 2016-096022 | A | 5/2016 |
| KR | 2014-0112506 | A | 9/2014 |
| WO | 2015/080946 | A1 | 6/2015 |
| WO | 2018/093981 | A1 | 5/2018 |

OTHER PUBLICATIONS

Molex 6.0mm Coeur CST High Current Connector System and Application Tools, dated Oct. 15, 2018, [online], [site visited Jul. 6, 2021]. Available from Internet, URL: https://www.molex.com/pdm_docs/as/2043130006-AS-000.pdf (Year: 2018).

Notice of allowance received for U.S. Appl. No. 29/753,408, dated Jul. 16, 2021, 16 pages.

Notice of allowance received for U.S. Appl. No. 29/753,431, dated Jul. 16, 2021, 16 pages.

Notice of allowance received for U.S. Appl. No. 29/753,446, dated Jul. 16, 2021, 16 pages.

Notice of allowance received for U.S. Appl. No. 29/753,451, dated Jul. 16, 2021, 16 pages.

Notice of allowance received for U.S. Appl. No. 29/753,461, dated Jul. 16, 2021, 16 pages.

Office Action Received for KR Application No. 10-2020-7033421 dated Feb. 16, 2021, 20 Pages. (11 Pages of English Translation and 9 Pages of Official notification).

Office Action received for CN Application No. 201780067826.1, dated Apr. 20, 2021, 16 Pages. (9 Pages of English Translation and 7 Pages of Official notification).

Extended European search report and opinion received for EP application No. 17871459 8, dated May 8, 2020, 11 pages.

Notification of Reasons for refusal received for JP application No. 2019-515860, dated Mar. 24, 2020, 15 pages (8 pages of English translation and 7 pages of official copy).

International Search Report and Written Opinion received for PCT application No. PCT/US2017/061910, dated Mar. 15, 2018, 9 pages.

International Preliminary Report on Patentability received for PCT Application No. PCT/US2017/061910, dated May 31, 2019, 8 pages.

Office Action received for JP Application No. 2020-159256, dated Aug. 31, 2021, 09 Pages (5 Pages of English Translation and 04 Pages of Official notification).

Notification of Reasons for Refusal received for JP application No. 2021-155092, dated Aug. 16, 2022, 8 pages. (4 pages of english translation and 4 pages of official copy).

FLOATING SOCKET CONNECTOR

RELATED APPLICATIONS

This application is a continuation of U.S. application Ser. No. 16/330,767, filed on Mar. 6, 2019, which claims priority to PCT Application No. PCT/US2017/061910, filed on Nov. 16, 2017, which further claims the domestic priority of U.S. Provisional Application Ser. No. 62/423,285, filed on Nov. 17, 2016, U.S. Provisional Application Ser. No. 62/428,753, filed on Dec. 1, 2016, U.S. Provisional Application Ser. No. 62/450,641, filed Jan. 26, 2017, U.S. Provisional Application Ser. No. 62/460,323, filed on Feb. 17, 2017, and U.S. Provisional Application Ser. No. 62/504,827, filed May 11, 2017. The contents of each of the aforementioned Applications are incorporated herein in their entireties.

TECHNICAL FIELD

This disclosure relates to the field of connectors, more specifically to board mounted and bus mounted power connectors.

BACKGROUND ART

Power connectors are used in equipment consuming high amounts of power and consequently utilize high current. In some instances, multiple connectors are mounted on printed circuit boards and bus bars in an array. In larger arrays of power connectors, alignment of a male pin to a female socket connector may be difficult due to a buildup of tolerances. High power systems can also generate heat and the resultant expansion of the system when carrying high current can cause relative movement between the male pin and the female socket connector.

SUMMARY

A socket connector is configured to mount within a hole in a component, such as a printed circuit board. The socket connector includes a base, a passageway extending therethrough and a channel extending outwardly from the passageway, a barrel including a wall having a passageway therethrough and a flange extending outwardly from the wall, at least one biasing member engages the flange and surrounding the wall, and a contact seated within the passageway of the barrel. The wall of the barrel is seated within the passageway of the base and the flange of the barrel is seated within the channel of the base. The barrel is configured for movement within the base to align a centerline of a pin inserted into the socket connector with a centerline of the hole of the component.

BRIEF DESCRIPTION OF THE DRAWINGS

The present invention is illustrated by way of example and not limited in the accompanying figures in which like reference numerals indicate similar elements and in which.

DETAILED DESCRIPTION OF THE PREFERRED EMBODIMENTS

Figure 1:
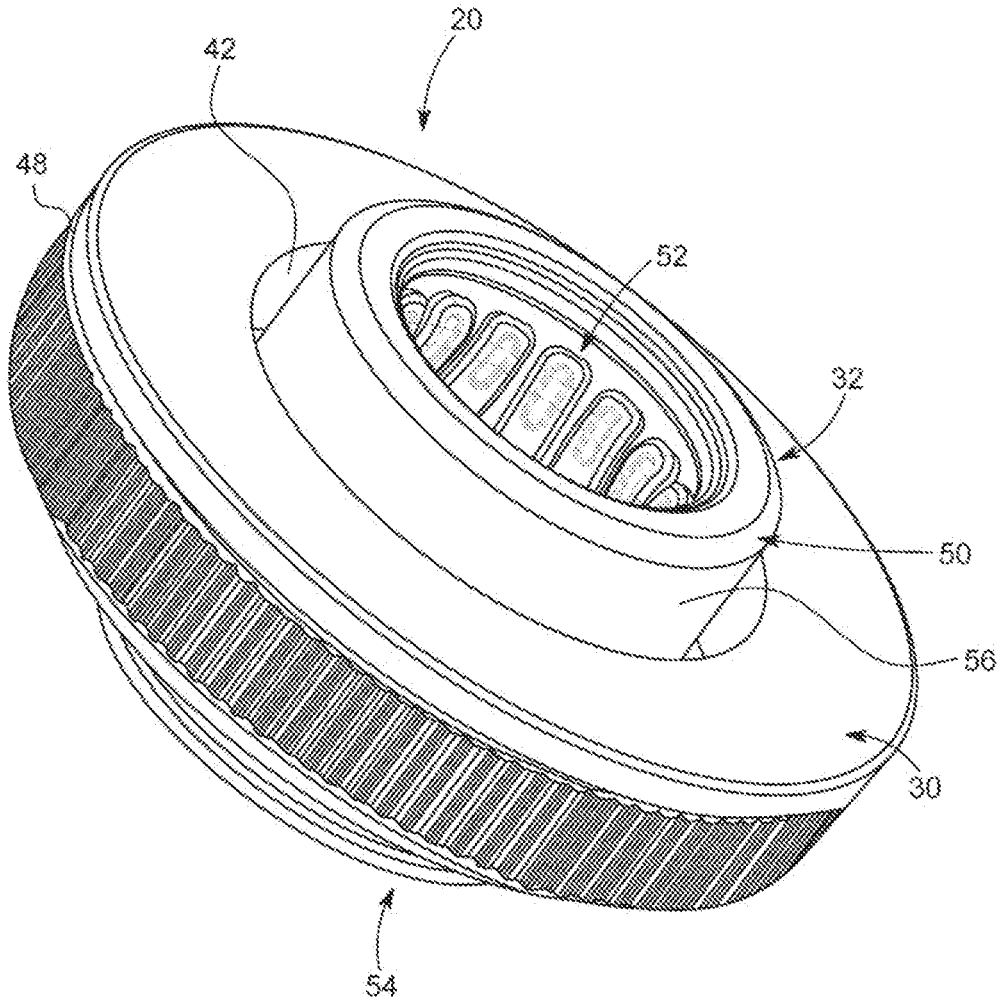
FIG. 1 depicts a perspective view of an embodiment of a socket connector.
Figure 2:
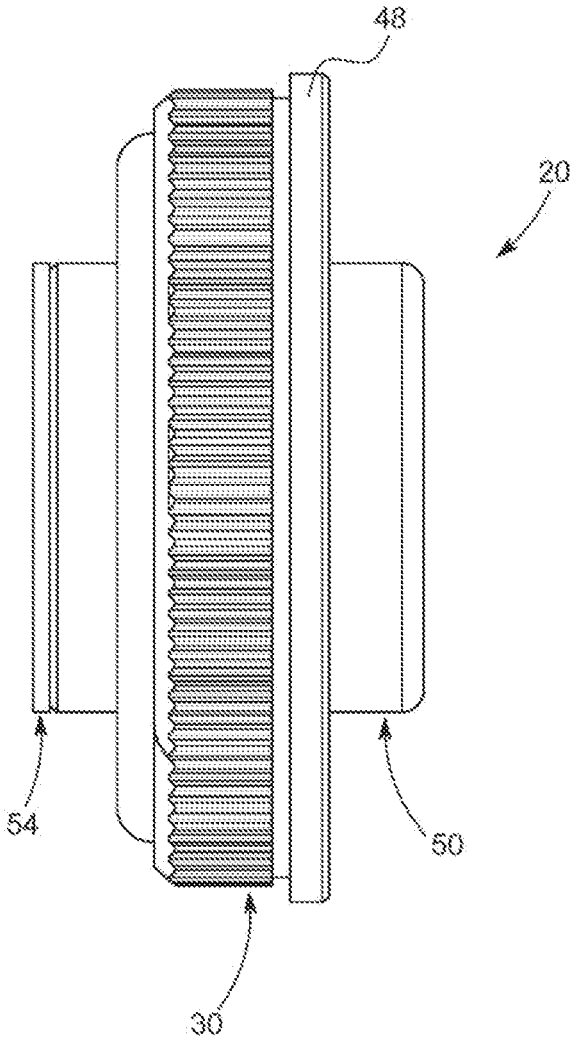
FIG. 2 depicts a side elevation view of the socket connector.
Figure 3:
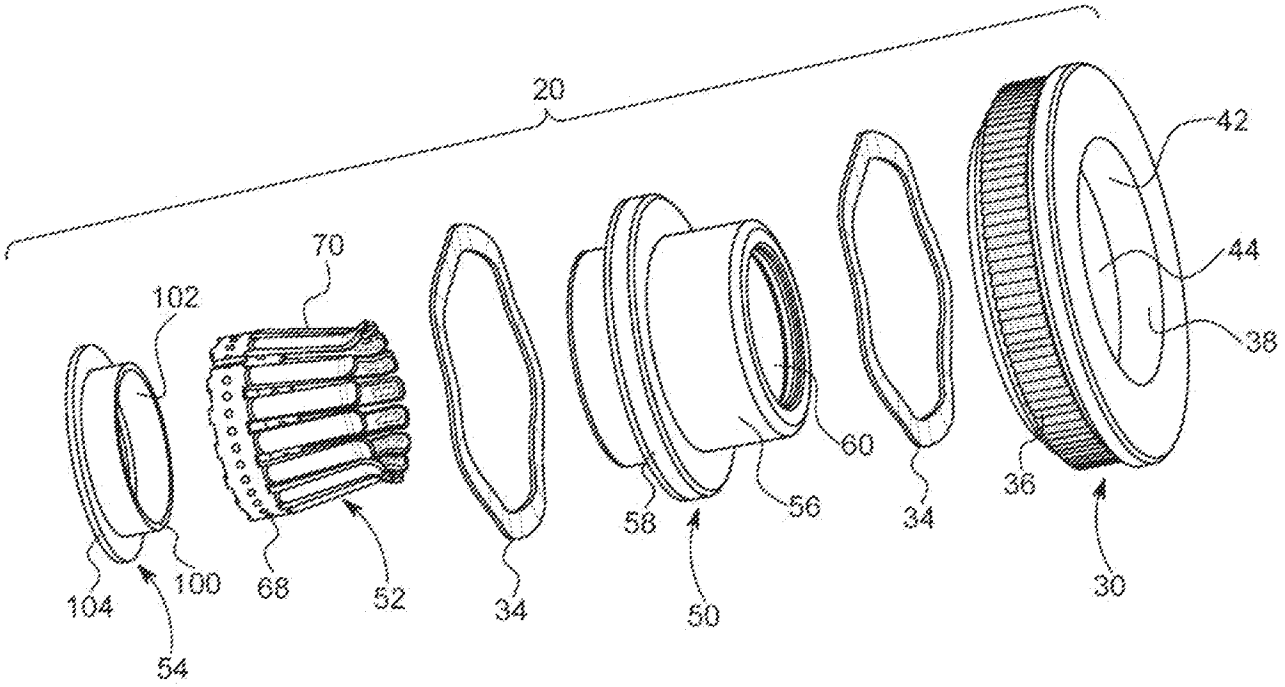
FIG. 3 depicts an exploded perspective view the socket connector.
Figure 4:
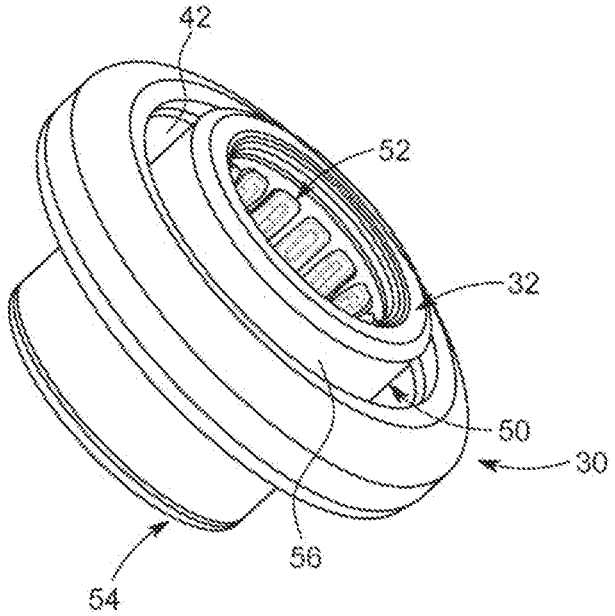
FIG. 4 depicts a perspective view of another embodiment of a socket connector.
Figure 5:
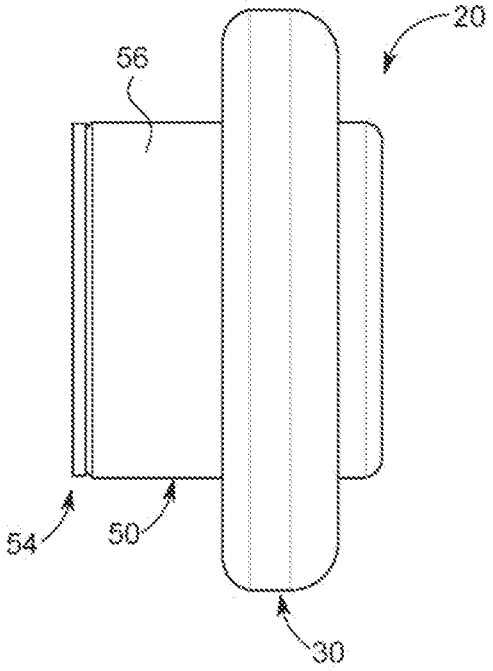
FIG. 5 depicts a side elevation view of the socket connector of FIG. 4.
Figure 6:
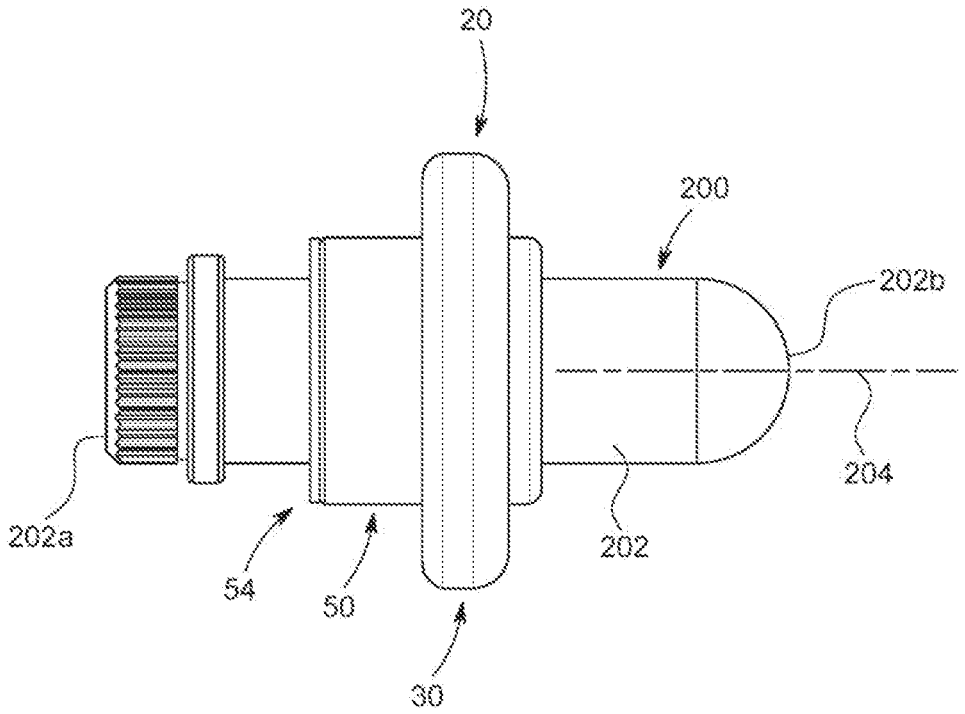
FIG. 6 depicts a side elevation view of the socket connector of FIG. 4 engaged with a pin.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

A floating socket connector 20, when used with a pin 200 mounted within the socket connector 20, connects components 300 together to form an electrical connection. For example, the socket connector 20, when used with the pin 200, may be used to connect a printed circuit board or flex circuit to a bus bar or pair of bus bars which may be arranged in a parallel fashion, or may be used to connect a first printed circuit board or flex circuit to a second printed circuit board or flex circuit. In an embodiment, the socket connector 20 is a power connector. As can be appreciated from the figures, the socket connector 20 provides a floating connection configuration. By "floating connection configuration", this means that the socket connector 20 and the pin 200 can move relative to each other. This floating design allows a certain degree of misalignment between the socket connector 20 and the pin 200 and the socket connector 20 automatically compensates for the misalignment while maintaining electrical contact.

The pin 200 is conventional and is formed of a body 202 having opposite ends 202*a*, 202*b* and an outer surface 202*d* which defines an outer diameter. A centerline 204 of the pin 200 is provided along the length of the pin 200 between the ends 202*a*, 202*b* and defines a longitudinal axis.

The components 300 are conventional. Each component 300 has first and second surfaces 300*a*, 300*b* and a through hole 302 therethrough in which the floating socket connector 20 may be mounted. A centerline 304 of the through hole 302 is provided along the height of the component 300 between the surfaces 300*a*, 300*b* and defines a longitudinal axis. In an embodiment, the first and second surfaces 300*a*, 300*b* are planar.

The socket connector 20 includes a base 30, a contact assembly 32 mounted within the base 30, and at least one biasing member 34. All components of the socket connector 20 are formed of a conductive material, such as metal. The base 30 is affixed to the component 300 as described herein. The contact assembly 32 is configured to move relative to the base 30 and thus, relative to the component 300 to which the base 30 is affixed.

Figure 7:
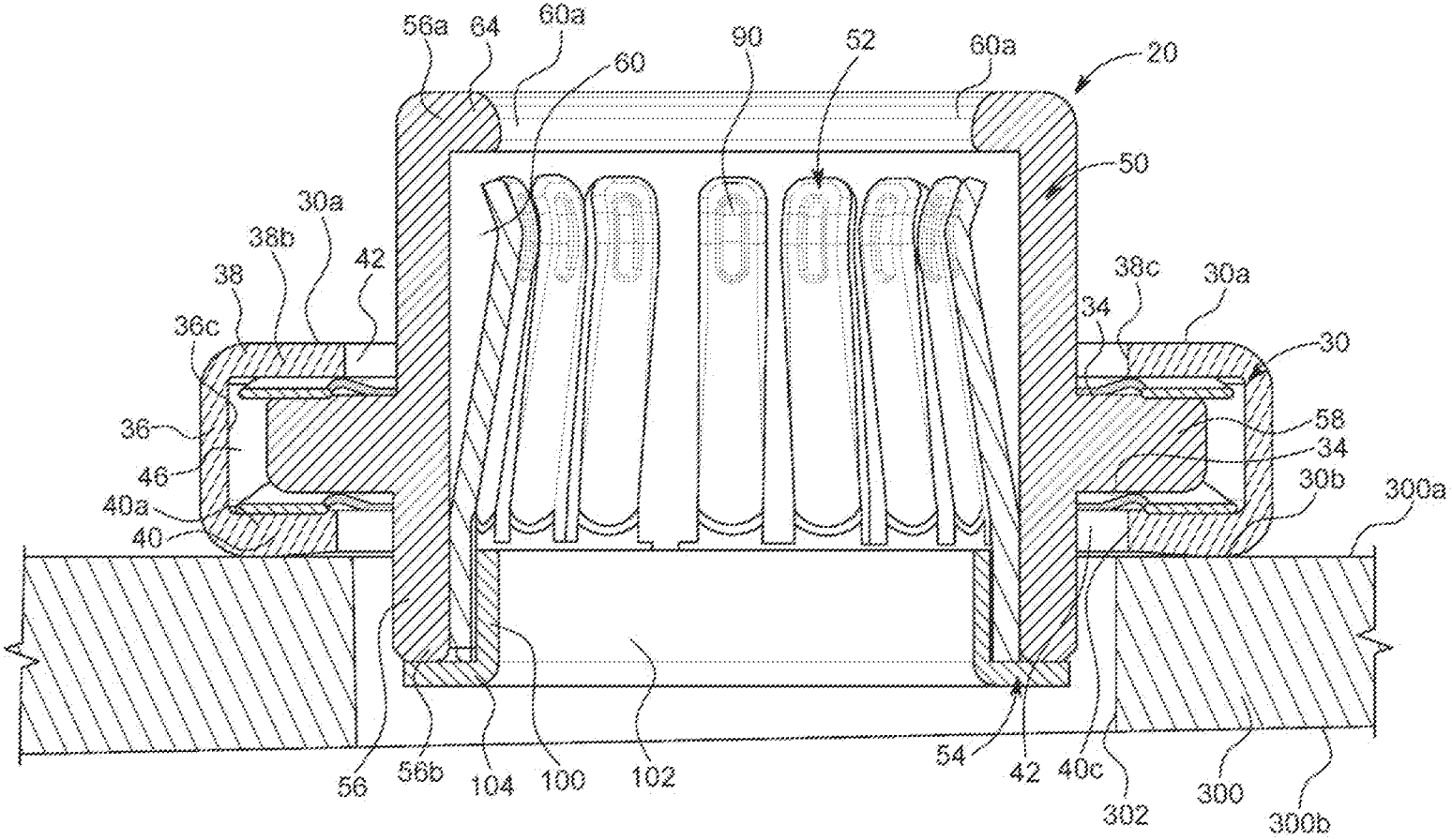
FIGS. 7-10 depict cross-sectional views of embodiments of the socket connector engaged with a component, such as a printed circuit board.
Figure 8:
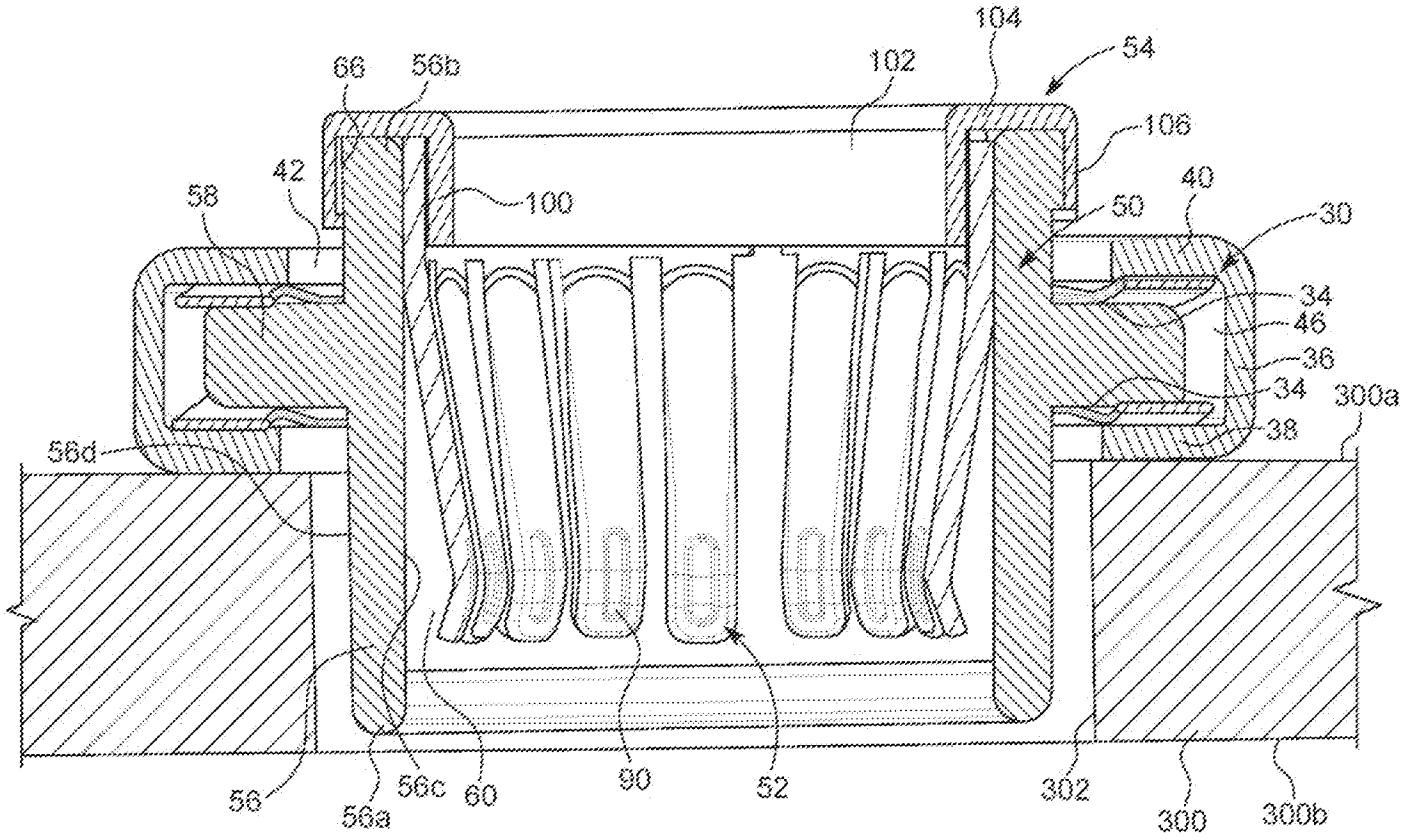
Figure 9:
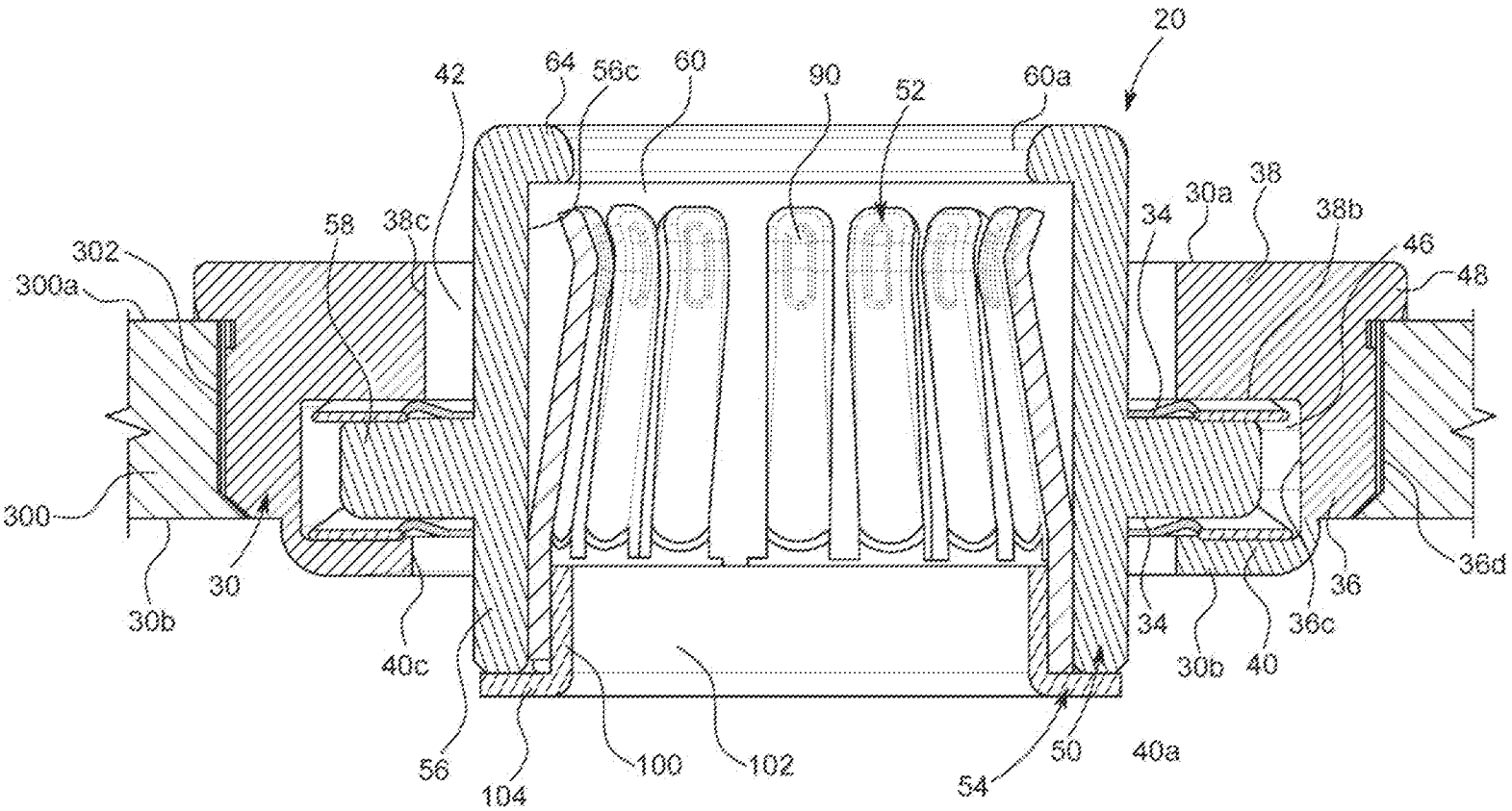

In an embodiment as shown in FIGS. 7-9, the base 30 is annular and has a generally U-shaped cross-section. The base 30 includes a vertical outer wall 36, a first wall 38 extending inwardly from an end of the outer wall 36, and a second wall 40 extending inwardly from the opposite end of the outer wall 36. In some embodiments, the first and second walls 38, 40 are perpendicular to the vertical outer wall 36. Inner surfaces 38*c*, 40*c* of the first and second walls 38, 40 form a passageway 42 therethrough which extends from a first end 30*a* of the base 30 to a second end 30*b* of the base 30. A centerline 44 of the base 30 is provided along the length of the base 30 between the ends 30*a*, 30*b* and defines a longitudinal axis. Surfaces 36*c*, 38*b*, 40*a* of the outer wall 36, the first wall 38 and the second wall 40, respectively, form a channel 46 which is in communication with and extends outwardly from the passageway 42. The channel 46 has a height which extends in the same direction as the centerline 44 which is less than the height of the passageway 42 which extends in the same direction as the centerline 44. In an embodiment, the surfaces 38*b*, 40*a* of the channel 46 are parallel to each other and surface 36*c* is perpendicular to the surfaces 38*b*, 40*a*. In an embodiment, the channel 46 is proximate to, but spaced from, the second end 30*b* of the base 30. In some embodiments, the walls 36, 38, 40 are annular such that the passageway 42 and the channel 46 are provided in a cylindrical configuration.

In some embodiments as shown in FIGS. 1, 2, 9 and 11, an outer surface 36*d* of the outer wall 36 has serrations thereon.

In some embodiments as shown in FIGS. 1, 2, 9 and 11, a lip 48 extends outwardly from the outer surface 36*d* of the outer wall 36 proximate to the first end 30*a*.

Figure 10:
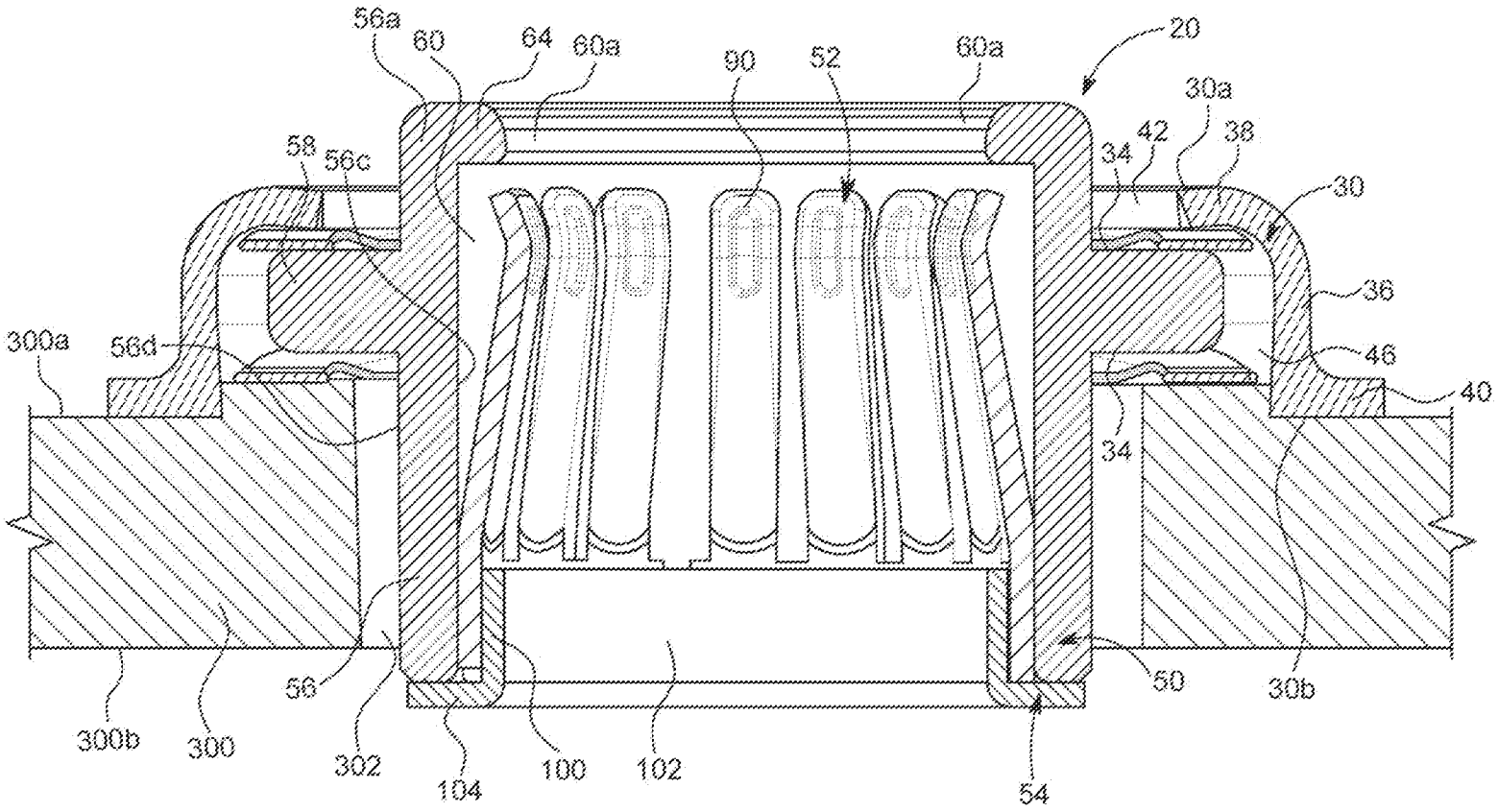
Figure 11:
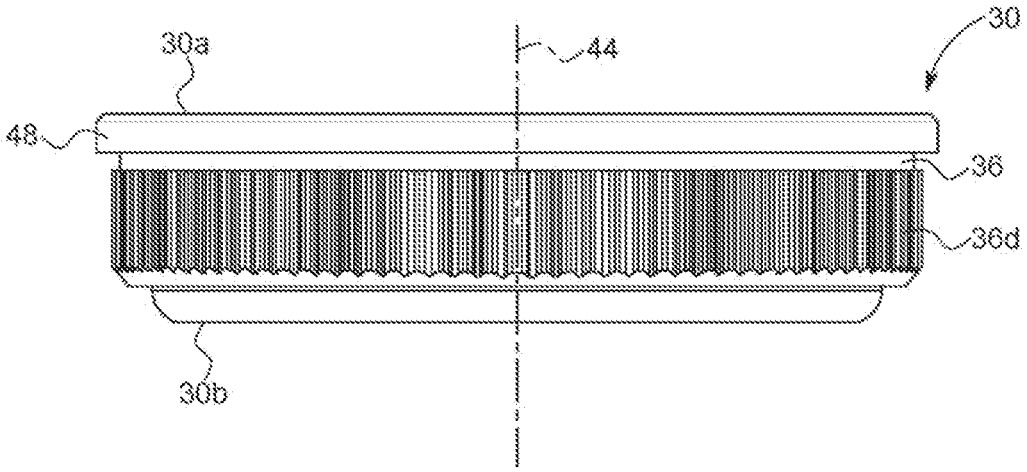
FIG. 11 depicts a side elevation view of a base of the socket connector of FIG. 1.
Figure 12:
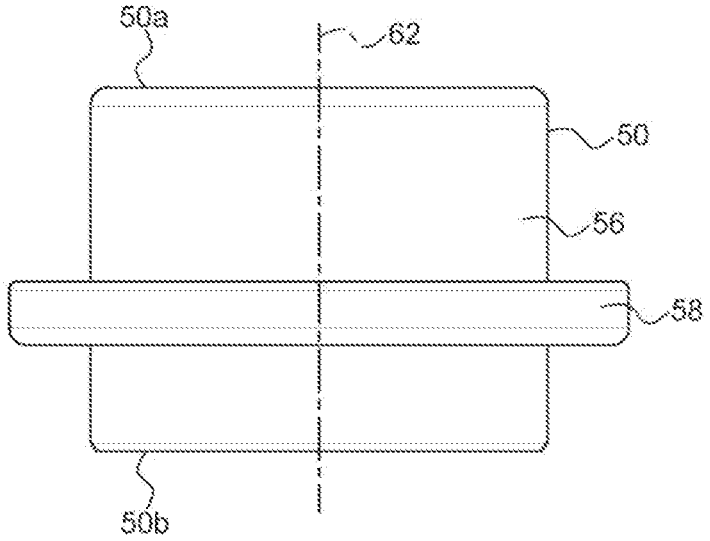
FIG. 12 depicts a side elevation view of a barrel of the socket connector of FIG. 1.

In an embodiment as shown in FIG. 10, the second wall 40 extends outwardly from the outer wall 36 instead of inwardly. As a result, the channel 46 is open to the second end 30*b* of the base 30.

The contact assembly 32 includes a barrel 50, a contact 52 and a cap 54.

The barrel 50 is formed of a vertical wall 56 and a flange 58 extending outwardly from an outer surface 56*d* of the vertical wall 56. An inner surface 56*c* of the wall 56 forms a passageway 60 which extends from a first end 50*a* of the barrel 50 to a second end 50*b* of the barrel 50. A centerline 62 of the barrel 50 is provided along the length of the barrel 50 between the ends 50*a*, 50*b* thereof and defines a longitudinal axis.

In some embodiments, the wall 56 and the flange 58 have a circular cross-section. The flange 58 can be provided at any position along the outer surface 56*d* of the wall 56. As shown in the drawings, the flange 58 is provided proximate to, but spaced from, a first end 56*a* of the wall 56.

In some embodiments as shown in FIGS. 7, 9 and 10, a flange 64 extends inwardly from an inner surface 56*c* of the wall 56, is spaced from the flange 58, and restricts the passageway 60. In an embodiment, the flange 64 extends inwardly from the wall 56 at the first end 56*a* of the wall 56, thereby restricting a first end 60*a* of the passageway 60. In some embodiments, the flange 64 is annular. The flange 64 may be eliminated In some embodiments as shown in FIG. 8, a flange 66 extends outwardly from the outer surface 56*d* and is spaced from the flange 58. In an embodiment, the flange 66 extends outwardly from the wall 56 at the second end 56*b* of the wall 56. In some embodiments, the flange 66 is annular. The flange 66 may be eliminated.

The contact 52 generally forms a hollow shape which generally conforms to the shape of the inner surface 56*c* of the wall 56 of the barrel 50. The contact 52 may be formed of an alloy with gold plating.

Figure 13:
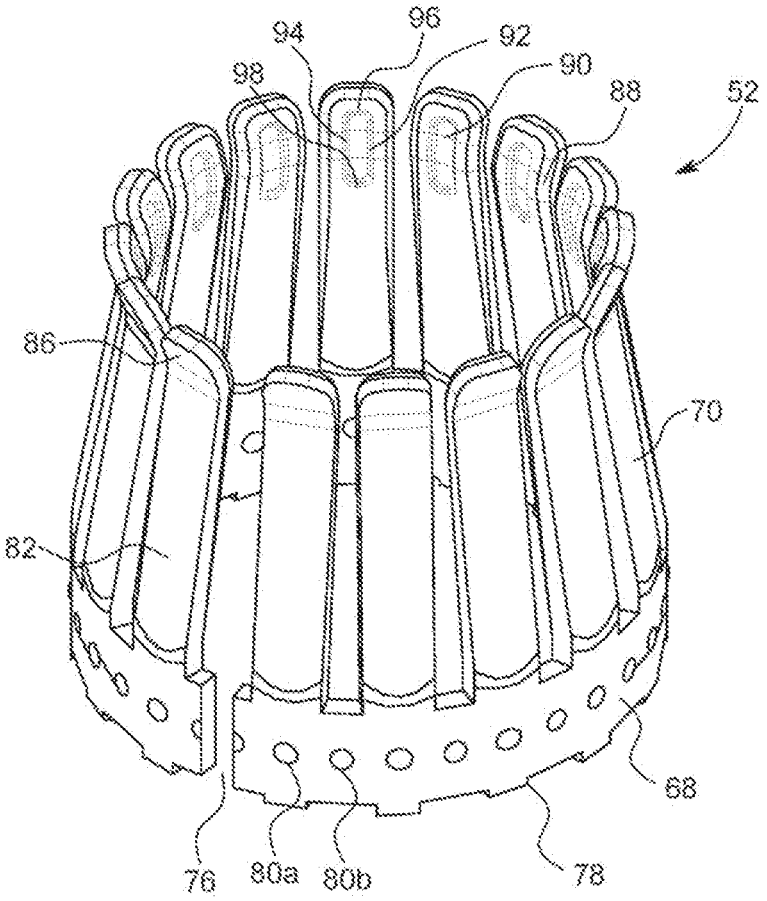
FIG. 13 depicts a perspective view of a contact of the socket connector.
Figure 14:
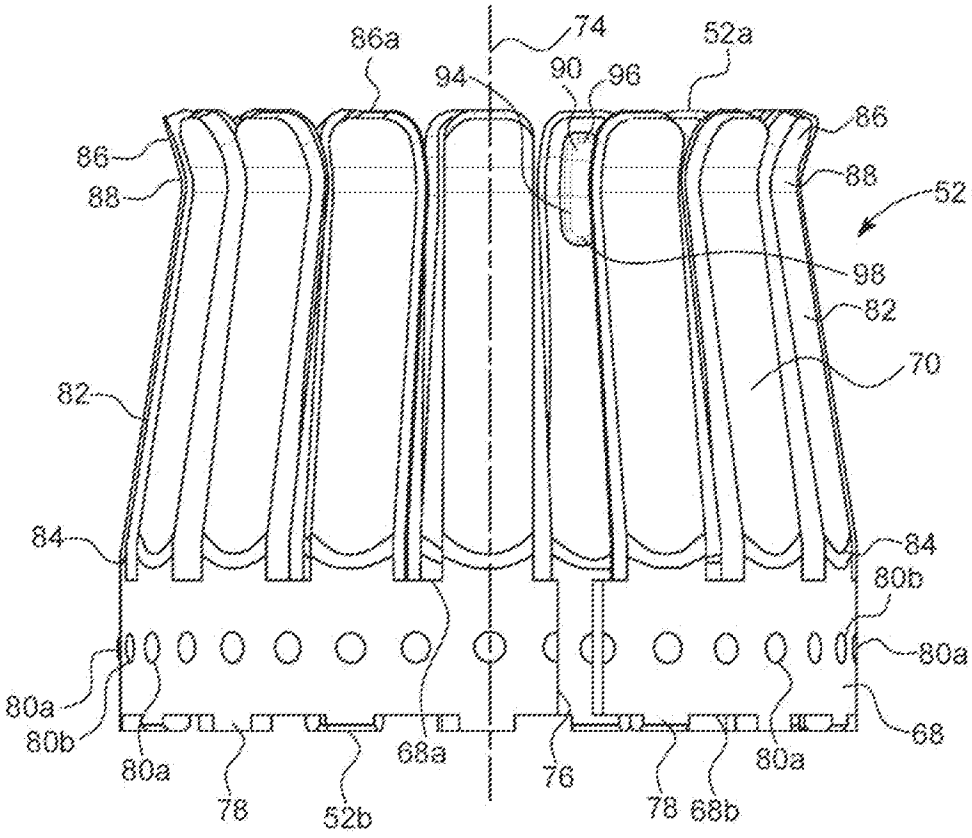
FIG. 14 depicts a side elevation view of the contact.
Figure 15:
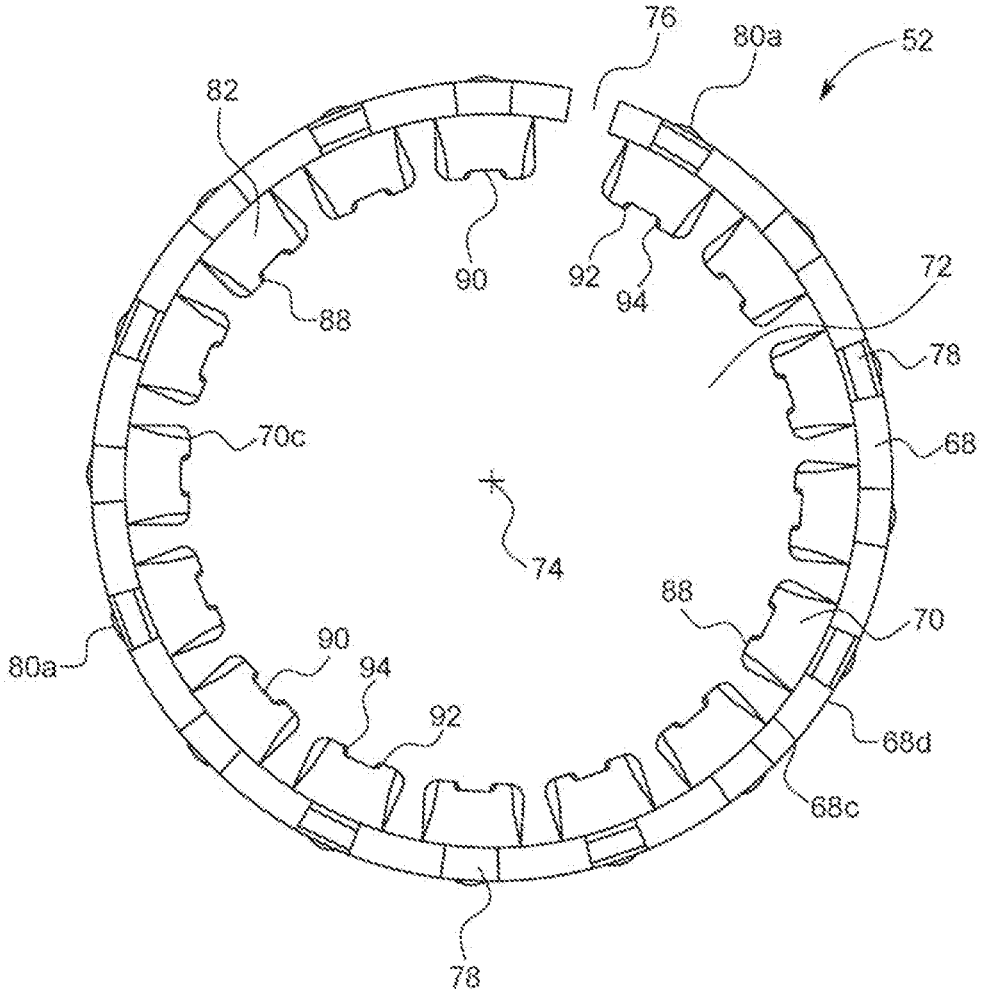
FIG. 15 depicts an end elevation view of the contact.

In an embodiment, as shown in FIGS. 13-15, the contact 52 is formed from a ring-like connecting portion 68 having a plurality of separate flexible beams 70 cantilevered therefrom such that a passageway 72 is formed therein which extends from a first end 52*a* of the contact 52 to a second end 52*b* of the contact 52. A centerline 74 of the contact 52 is provided along the length of the contact 52 between the ends 52*a*, 52*b* and defines a longitudinal axis.

The connecting portion 68 has first and second ends 68*a*, 68*b*, an inner surface 68*c* and an outer surface 68*d*. In an embodiment, the connecting portion 68 is discontinuous around its circumference such that a slot 76 is provided.

In some embodiments, the connecting portion 68 has a plurality of spaced apart nubs 78 extending from the second end 68*b* thereof. In an embodiment, the nubs 78 extend in a longitudinal direction parallel to the centerline 76. Each nub 78 has a length which is substantially less than the length of the connecting portion 68. In an embodiment, the nubs 78 extend in the same plane as the connecting portion 68. In an embodiment, the nubs 78 have a curved profile which matches the curved profile of the connecting portion 68.

In some embodiments, the connecting portion 68 has a plurality of spaced apart dimples or protrusions 80*a*, 80*b* provided thereon. In an embodiment, the protrusions 80*a*, 80*b* are formed as spherical domes. In an embodiment, the protrusions 80*a*, 80*b* are elongated. The protrusions 80*a*, 80*b* may be aligned around the circumference of the connecting portion 68. The protrusions 80*a*, 80*b* may alternate between a protrusion 80*a* extending outwardly from the outer surface 68*d* of the connecting portion 68 and a protrusion 80*b* extending inwardly from the inner surface 68*c* of the connecting portion 68. Other patterns of outwardly extending protrusions 80*a* and inwardly extending protrusion 80*b* may be provided around the circumference of the connecting portion 68. The number of protrusions 80*a* extending outwardly may differ from the number of protrusions 80*b* extending inwardly.

The beams 70 extend from the first end 68*a* of the connecting portion 68. Each beam 70 is parallel to, and radially spaced from, the centerline 74. The beams 70 are spaced apart from each other around the circumference of the connecting portion 68.

In an embodiment, each beam 70 has a first portion 82 which extends at an angle from the connecting portion 68 at a corner 84, and a second portion 86 which extends at an angle from an end of the first portion 82 at a corner 88. The first portion 82 angles inwardly toward the centerline 74, and the second portion 86 angles outwardly from the centerline 74. The corners 88 may be radiused. In an embodiment, the corners 88 are aligned around the circumference of the contact 52 and define an inner diameter. The inner diameter defined by the corners 88 is less than the diameter of the pin 200.

Figure 17:
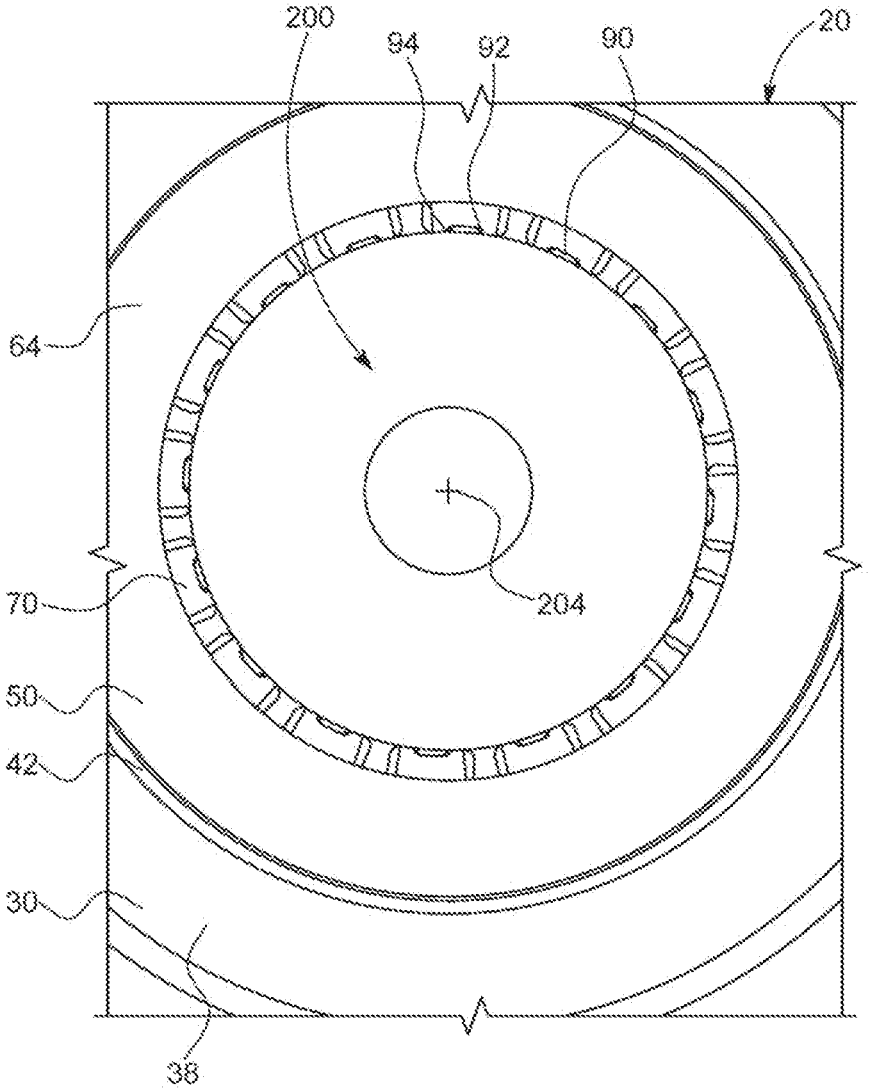
FIG. 17 depicts an end elevation view of the socket connector having a pin mounted therein.

In an embodiment, each beam 70 has a recess 90 along its inner surface 70*c* which is spaced from the free end 86*a* of the second portion 84. The recess 90 has elongated side edges 92, 94 which extend parallel to the centerline 74 of the contact 52 and end edges 96, 98 at the opposite ends of the side edges 92, 94. The recess 90 extends along a section of the first portion 82, along the corner 84 and along a section of the second portion 88. The recess 90 allows the circumference of the body 202 of the pin 200 to be accommodated therein to provide two points of contact with each beam 70 as shown in FIG. 17.

The contact 52 may be stamped out of a flat sheet of material and rolled into the shape. The contact 52 may be machined into the shape.

In an embodiment as shown in FIGS. 7, 9 and 10, the cap 54 has an annular first wall 100 which defines a central passageway 102, and a second wall 104 extending radially outwardly from and perpendicular to the first wall 100. In an embodiment, the cap 54 additionally has an annular third wall 106, see FIG. 8, extending from and perpendicular to the second wall 104 and generally parallel to the first wall 100.

The contact 52 is seated within the passageway 60 of the barrel 50 such that the second end 52*a* of the contact 52 generally aligns with the second end 50*b* of the barrel 50, the first end of the contact 52 is spaced from the first end 50*a* of the barrel 50, and the centerlines 62, 74 align. The outer surface 68*d* of the connecting portion 68 is proximate to the inner surface 56*d* of the wall 56 of the barrel 50 and the outwardly extending protrusions 80*a* abut against the inner surface 56*d* of the wall 56. The cap 54 secures the barrel 50 and the contact 52 together. In an embodiment, the cap 54 is press fit to the barrel 50 and contact 52. In an embodiment, the cap 54 is crimped to the barrel 50 and contact 52. The wall 100 of the cap 54 engages against the inwardly extending protrusions 80*a* of the barrel 50. The wall 100 of the cap 54 has a diameter which is less than a diameter defined by the inwardly extending protrusions 80*a*. Therefore, when the wall 100 of the cap 54 is engaged with the connecting portion 68, the protrusions 80*a*, 80*b* are deformed. The wall 104 engages the end 56*b* of the wall 56 of the barrel 50. In some embodiments, the ends of the nubs 78 engage against the wall 104 and form electrical paths. In the embodiment of the cap 54 which includes the wall 106, the wall 106 engages with the flange 66. In some embodiments, the flange 66 seats within a recess in the wall 106.

In an embodiment, the biasing member(s) 34 are wave springs. In an embodiment, the biasing member(s) 34 are spring washers. In an embodiment, the biasing member(s) 34 are thrust washers.

The contact assembly 32 seats within the base 30. The wall 56 of the barrel 50 seats within the passageway 42 of the base 30. The wall 56 extends outwardly from the ends 30*a*, 30*b* of the base 30. The flange 58 of the barrel 50 seats within the channel 46 of the base 30 and extends into the passageway 42 of the base 30. The contact assembly 32 can be seated such that the first end 56*a* of the wall 56 is proximate to the wall 38 of the base 30 or such that the second end 56*b* of the wall 56 is proximate to the wall 38 of the base 30. The wall 56 has a diameter which is less than the passageway 42 of the base 30 and the flange 58 is smaller than the channel 46 of the base 30 but has a diameter which is greater than the passageway 42 of the base 30. As a result, the contact assembly 32 can move relative to the base 30, but cannot be pulled outwardly from the first end 30*a* of the base 30.

When the barrel 50 shown in FIGS. 7-9 is used, in an embodiment, a first biasing member 34 is seated between, and abuts, the flange 58 and the first wall 38 and further surrounds the wall 56 of the barrel 50, and a second biasing member 34 is seated between, and abuts, the flange 58 and the second wall 40 and further surrounds the wall 56 of the barrel 50. In an embodiment, only the first biasing member 34 is provided and the flange 58 engages the second wall 40. In an embodiment, only the second biasing member 34 is provided and the flange 58 engages the first wall 38. The socket connector 20 of this embodiment is mounted to the component 300 either by a surface mount or by press fitting the socketing connector 20 into the through hole 302. When surface mounted, either the first wall 38 or the second wall 40 of the base 30 is affixed to the component 300, such as, for example, by soldering the base 30 to a conductive trace on component 300, and the wall 56 of the barrel 50 seats within the through hole 302 of the component 300. The wall 56 of the barrel 50 has a diameter which is less than the diameter of the through hole 302. When press fit, the outer surface 36*d* of the wall 36 of the base 30 engages the wall forming the through hole 302 of the component 300; the through hole 302 is plated to provide an electrical connection to the conductive trace on the component 300. When press fit, the lip 48 prevents the further movement of the socket connector 20 into the through hole 302. If serrations are provided on the wall 36, the serrations bite into the wall forming the through hole 302. As a result, the contact assembly 32 can move relative to the base 30 and relative to the component 300, but the base 30 cannot move relative to the component 300.

When the barrel 50 shown in FIG. 10 is used, in an embodiment, a first biasing member 34 is seated between, and abuts, the flange 58 and the first wall 38 and further surrounds the wall 56 of the barrel 50, and a second biasing member 34 abuts the opposite side of the flange 58 and surrounds the wall 56 of the barrel 50. When mounted to the component 300 as described herein, the second biasing member 34 engages against the surface 300*a* of the component 300. In an embodiment, only the first biasing member 34 is provided and the flange 58 engages the surface 300*a* of the component 300. In an embodiment, only the second biasing member 34 is provided and the flange 58 engages the first wall 38. The socket connector 20 of this embodiment can only be surface mounted to the component 300. The second wall 40 of the base 30 is affixed to the component 300, such as, for example, by welding, and the wall 56 of the barrel 50 seats within the through hole 302 of the component 300. The wall 56 of the barrel 50 has a diameter which is less than the diameter of the through hole 302. As a result, the contact assembly 32 can move relative to the base 30 and relative to the component 300.

The pin 200 can be inserted into the contact 52 from either direction. That is, the pin 200 can be inserted into the contact 52 such that the pin 200 first passes the connecting portion 68 and then engages with the corners 88 of the contact 52, or the pin 200 can be inserted into the contact 52 such that the pin 200 first passes the free ends 86*a* of the beams 70 and then engages with the corners 88 of the contact 52. When the pin 200 engages with the corners 88 of the contact 52, the beams 70 flex and generally straighten. The outwardly turned ends 86*a* of the second portions 86 may contact the inner surface 56*c* of the wall 56 of the barrel 50. Electrical signals flow from the pin 200, through the beams 70, through the connecting portion 68, though the barrel 50 and the cap 54, through the biasing member(s) 34, through the base 30 to the component 300.

The flange 58 of the barrel 50 can translate in a radial direction and rotate within the channel 46 of the base 30. The biasing member(s) 34 bias the flange 58 against the opposing wall 38, 40 of the barrel 50 to maintain electrical contact between the flange 58 and the base 30, and consequently with the contact 52. Since the contact assembly 32 can move relative to the base 30, a certain degree of misalignment between the socket connector 20 and the pin 200 is automatically compensated for, while maintaining electrical contact. When misaligned, the centerline 204 of the pin 22 does not align with the centerline 44 of the base 30 during insertion. If there is misalignment, the contact assembly 32 moves or floats by the flange 58 engaging with the biasing member(s) 34 to compress the biasing member(s) 34.

In this regard, if two biasing members 34 are provided in the form of springs, the springs may have different spring characteristics to provide for a stiffer spring and a softer spring. The softer spring deflects first to provide tolerance and after the softer spring is deflected, the stronger spring deflects to provide tolerance. For example, if wave springs are provided, one wave spring may have more waves than the other wave spring. For example, one wave spring may have twelve waves, while the other wave spring has six waves. In a preferred embodiment, the stiffer spring has double the waves of the softer spring.

Figure 16:
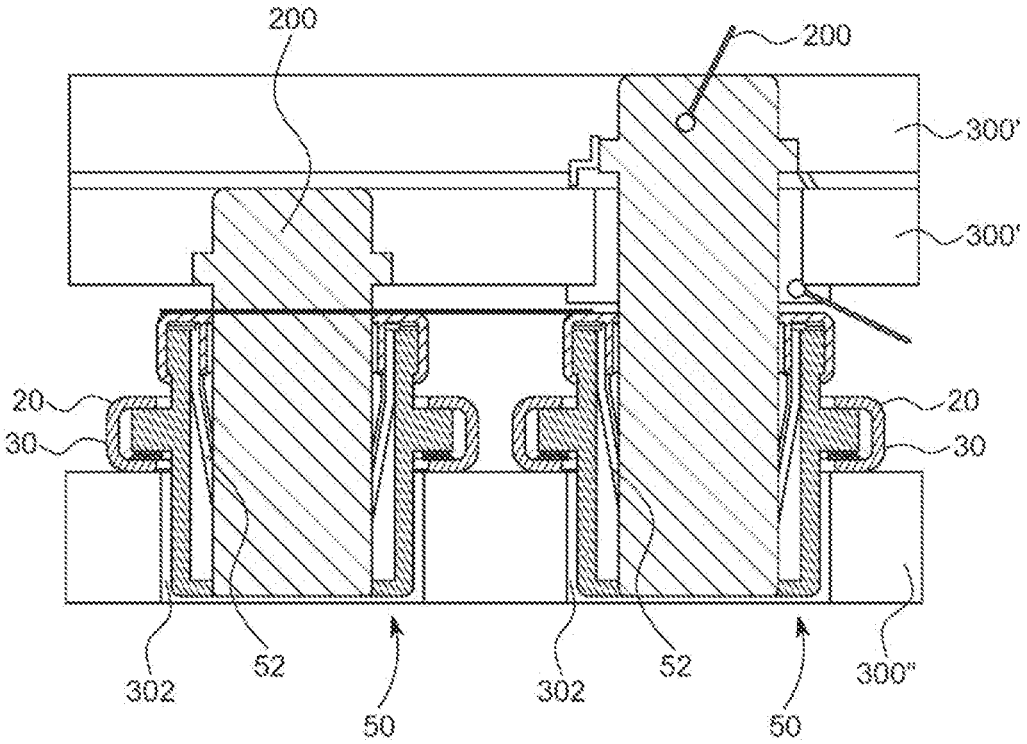
FIG. 16 depicts a cross-sectional view of two socket connectors mounted to component, such as bus bars and printed circuit boards, by a pin.

An example of an implementation of the socket connector 20 with connector 300 is shown in FIG. 16. In FIG. 16, a pair of bus bars 300' and a printed circuit board 300" are provided. Each pin 200 is secured to a respective one of the bus bars 300' and is electrically isolated from the other one of the respective bus bars 300'. Each pin 200 is received in a respective socket connector 20 mounted on the printed circuit board 300" and makes electrical contact with the socket connector 20 as described herein. The contact assembly 32 moves relative to the base 30 to compensate for any tolerance stack. Movement resulting from expansion caused by the generation of heat can also be absorbed by the float between the contact assembly 32 and the base 30.

Figure 18:
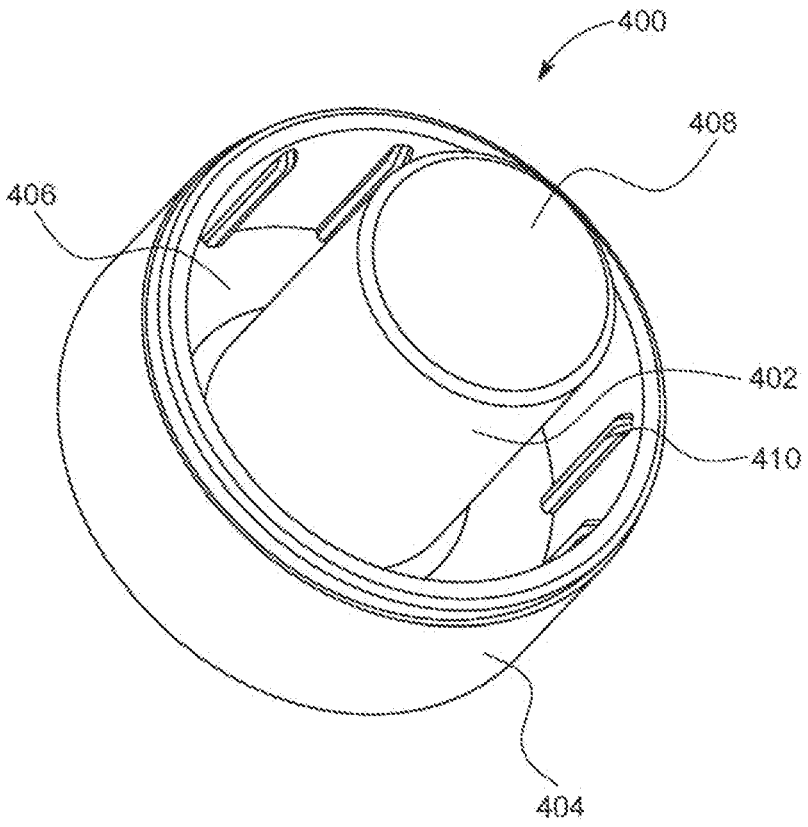
FIG. 18 depicts a perspective view of an alignment tool used to surface mount the socket connector onto the component.
Figure 19:
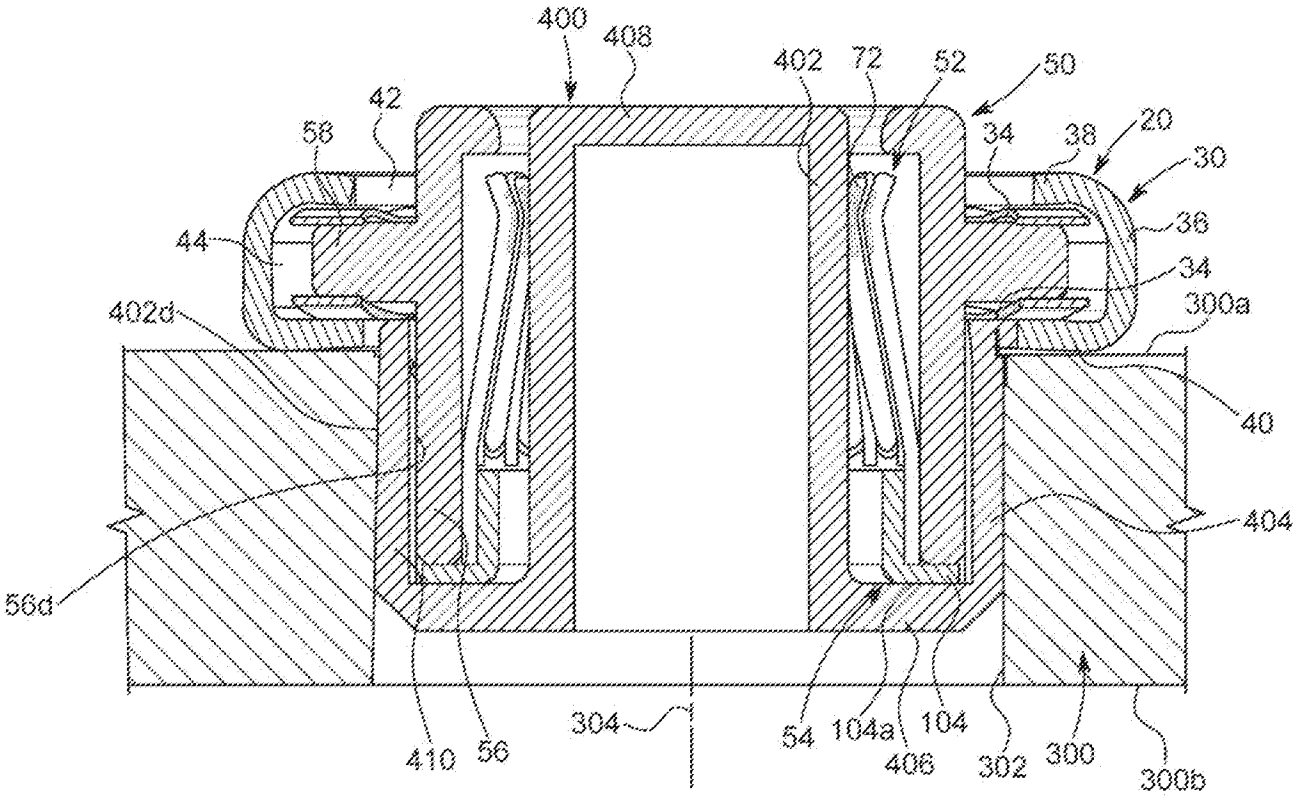
FIG. 19 depicts a cross-sectional view of the socket connector, the component and the alignment tool.

To facilitate surface mounting of the socket connector 20 to the component 300, an alignment tool 400, see FIG. 18, is utilized. The alignment tool 400 includes an inner cylindrical wall 402, an outer cylindrical wall 404 and a base wall 406 which spaces the inner cylindrical wall 402 from the outer cylindrical wall 404. The inner and outer walls 402, 404 are parallel to each other and extend in the same direction from the base wall 406. An end of the inner cylindrical wall 402 may be closed by a wall 408. The outer cylindrical wall 404 has a plurality of fingers 410 extending from an inner surface of the outer wall 404. In use as shown in FIG. 19, the socket connector 20 is disposed on the alignment tool 400 such that the inner cylindrical wall 402 seats within the passageway 72 of the contact 52, the base 406 engages a second end 104*b* of the wall 104 of the cap 54, and the fingers 410 on the outer cylindrical wall 404 engage the outer surface 56*d* of the wall 56 of the barrel 50 and extends into the passageway 42 of the base 30. Thereafter, the assembled socket connector 20 and alignment tool 400 are seated within the through hole 302 in the component 300 until the wall 38 or 40 of the base 30 which is being surface mounted to the component 300 engages with the surface 300*a* of the component 300. The outer cylindrical wall 404 is sized to be slightly smaller than the through hole 302 such that an outer surface 402*d* of the outer cylindrical wall 404 engages the wall forming the through hole 302 in the component 300. After the wall 38 or 40 of the base 30 is surface mounted to the component 300, the aligned centerlines 62, 74 of the barrel 50 and the contact 52 align with the centerline 304 of the component 300. After the socket connector 20 is surface mounted to the component 300, the alignment tool 400 is removed from the socket connector 20 by pulling the alignment tool 400 out of the other side of the through hole 302.

The use of the terms "a" and "an" and "the" and "at least one" and similar references in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All processes described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A socket connector comprising:

a first member which is at least partially formed of a conductive material, the first member being configured to be mounted to a first electrical component, the first member having first and second opposite ends, the first member defining a first passageway which extends therethrough in a first direction and which is open to at least one of the first and second ends of the first member;

a second member which is at least partially formed of a conductive material, the second member being configured to receive a second electrical component, the second member being configured for movement within the first member, the second member having first and second opposite ends, the second member defining a second passageway which extends therethrough in the first direction and which is open to at least one of the first and second ends of the second member, the second passageway bounded by an inner surface of a wall of the second member, the wall being positioned within the first passageway, the second member being configured to be held by the first member such that the second member cannot be separated from the first member; and a third member which is at least partially formed of a conductive material, the third member being configured to maintain an electrical connection between the first member and the second member, to thereby maintain an electrical connection between the first electrical component and the second electrical component, wherein the first member defines a channel which extends outwardly from the first passageway in a second direction, wherein the first direction is different from the second direction, and wherein the second member has a flange which extends outwardly from an outer surface of the wall in the second direction, the flange being at least partially positioned within the channel of the first member.

2. The socket connector as defined in claim 1, wherein the first passageway is open to both of the first and second ends of the first member, and wherein the second passageway is open to both of the first and second ends of the second member.

3. The socket connector as defined in claim 1, wherein the third member is configured to maintain an electrical connection between the first member and the flange of the second member.

4. The socket connector as defined in claim 1, wherein the channel is not open to either of the first or second ends of the first member.

5. The socket connector as defined in claim 1, wherein the first direction is a longitudinal direction, and wherein the second direction is a radial direction, the radial direction being orthogonal to the longitudinal direction.

6. The socket connector as defined in claim 1, wherein the first electrical component is a printed circuit board, and wherein the second electrical component is a pin.

7. The socket connector as defined in claim 6, wherein the printed circuit board has a through-hole formed therein to define an inner wall, wherein the first member is configured to be mounted to the inner wall.

8. The socket connector as defined in claim 1, wherein the third member is a biasing member.

9. The socket connector as defined in claim 8, wherein the biasing member is a wave spring.

10. The socket connector as defined in claim 1, further comprising a contact that is held in the second passageway of the second member, the contact being configured to maintain an electrical connection between the second electrical component and the second member, to thereby maintain an electrical connection between the first electrical component and the second electrical component.

11. A socket connector comprising:

a first member which is at least partially formed of a conductive material, the first member being configured to be mounted to a first electrical component, the first member having first and second opposite ends, the first member defining a first passageway which extends therethrough in a first direction and which is open to at least one of the first and second ends of the first member;

a second member which is at least partially formed of a conductive material, the second member being configured to receive a second electrical component, the second member being configured for movement within the first member, the second member having first and second opposite ends, the second member defining a second passageway which extends therethrough in the first direction and which is open to at least one of the first and second ends of the second member, the second passageway bounded by an inner surface of a wall of the second member, the wall being positioned within the first passageway, the second member being configured to be held by the first member such that the second member cannot be separated from the first member; and a third member which is at least partially formed of a conductive material, the third member being configured to maintain an electrical connection between the first member and the second member, to thereby maintain an electrical connection between the first electrical component and the second electrical component, wherein the first electrical component is a printed circuit board, and wherein the second electrical component is a pin, and wherein the printed circuit board has a surface and a through-hole formed therethrough to define an inner wall, wherein the first member is configured to be mounted to the surface of the printed circuit board and at least a portion of the second member is configured to be positioned within the through-hole of the printed circuit board and not contact the inner wall.

12. A socket connector comprising:

a base which is at least partially formed of a conductive material, the base being configured to be mounted to a first electrical component, the base having first and second opposite ends, the base defining a base passageway which extends therethrough in a longitudinal direction;

a barrel which is at least partially formed of a conductive material, the barrel being configured to receive a second electrical component, the barrel having first and second opposite ends, the barrel defining a barrel passageway which extends therethrough in the first direction and which is open to at least one of the first and second ends of the barrel, the barrel passageway bounded by an inner surface of a wall of the barrel, the wall being positioned within the base passageway, the barrel being in electrical connection with the base; and a removable alignment device which is formed of a non-conductive material, the removable alignment device having an inner wall, an outer wall, an end wall and a base wall, the end wall closing off a first end of the inner wall, the base wall separating a second end of the inner wall from the outer wall, the inner wall being at least partially positioned within the barrel passageway, the inner wall being separated from the wall of the barrel, the outer wall engaging an outer surface of the wall of the barrel.

13. The socket connector as defined in claim 12, wherein the outer wall extends into the base passageway.

14. The socket connector as defined in claim 12, wherein the outer wall has a plurality of fingers extending from an inner surface thereof, the plurality of fingers engaging the outer surface of the wall of the barrel.

15. The socket connector as defined in claim 12, further comprising a contact, the contact being positioned within the barrel passageway, the contact being positioned between the wall of the barrel and an outer surface of the inner wall.

16. The socket connector as defined in claim 15, further comprising a cap attached to the contact and the barrel, the cap being in contact with the base wall.

17. The socket connector as defined in claim 12, wherein a surface of the end wall is substantially flush with the first end of the wall of the barrel.

18. The socket connector as defined in claim 12, wherein an outer surface of the outer wall is configured to engage a wall forming a through-hole of the first electrical component.

19. The socket connector as defined in claim 12, wherein, when the outer wall of the removable alignment device is engaged with the outer surface of the wall of the barrel, the barrel is substantially prevented from movement in a second direction relative to the base, wherein the first direction is different from the second direction, and wherein when the outer wall of the removable alignment device is disengaged from the outer surface of the wall of the barrel and the removable alignment device is removed, the barrel is allowed to move in the second direction relative to the base.

20. The socket connector as defined in claim 19, wherein the first direction is a longitudinal direction, and wherein the second direction is a radial direction, the radial direction being orthogonal to the longitudinal direction.

21. The socket connector as defined in claim 12, wherein a first inner cavity is defined between the inner wall and the end wall, wherein the first inner cavity is open proximate to the second end of the inner wall, and wherein a second inner cavity is defined between the inner wall and the wall of the barrel, wherein the second inner cavity is open proximate to the first end of the inner wall.

22. A socket connector comprising:

a first member which is at least partially formed of a conductive material, the first member being configured to be mounted to a first electrical component;

a second member which is at least partially formed of a conductive material, the second member being configured to receive a second electrical component, the second member being held by the first member, the second member configured to be floatable relative to the first member; and first and second biasing members which are held within the first member, the first and second biasing members configured to maintain an electrical connection between the first member and the second member, to thereby maintain an electrical connection between the first electrical component and the second electrical component.

23. The socket connector as defined in claim 22, wherein the second member has an outer cylindrical wall and a flange which extends outwardly from the outer cylindrical wall, wherein the flange is configured to cause the second member to be held by the first member.

24. The socket connector as defined in claim 23, wherein the flange has a first outer surface, wherein the first member has a first inner surface, and wherein the first biasing member is held between the first outer surface of the flange and the first inner surface of the first member.

25. The socket connector as defined in claim 24, wherein the first biasing member is a wave spring.

26. The socket connector as defined in claim 24, wherein the flange has a second outer surface, wherein the first member has a second inner surface, and wherein the second biasing member is held between the second outer surface of the flange and the second inner surface of the first member.

27. The socket connector as defined in claim 26, wherein the second biasing member is a wave spring.

28. The socket connector as defined in claim 26, wherein the second biasing member surrounds the outer cylindrical wall of the second member.

29. The socket connector as defined in claim 28, wherein the second biasing member is a wave spring.

30. The socket connector as defined in claim 24, wherein the first biasing member surrounds the outer cylindrical wall of the second member.

31. The socket connector as defined in claim 30, wherein the first biasing member is a wave spring.

32. The socket connector as defined in claim 23, further comprising a removable alignment device which is formed of a non-conductive material, the removable alignment device having an inner wall, an outer wall, an end wall and a base wall, the end wall closing off a first end of the inner wall, the base wall separating a second end of the inner wall from the outer wall, the inner wall being at least partially positioned within the outer cylindrical wall of the second member, the outer wall being at least partially positioned around the outer cylindrical wall of the second member.

33. The socket connector as defined in claim 22, wherein the first and second biasing members are wave springs.

34. The socket connector as defined in claim 22, further comprising a contact that is held in the second member, the contact being configured to maintain an electrical connection between the second electrical component and the second member, to thereby maintain an electrical connection between the first electrical component and the second electrical component.

35. The socket connector as defined in claim 34, further comprising a removable alignment device which is formed of a non-conductive material, the removable alignment device having an inner wall, an outer wall, an end wall and a base wall, the end wall closing off a first end of the inner wall, the base wall separating a second end of the inner wall from the outer wall, the inner wall being at least partially positioned within the contact, the outer wall being at least partially positioned around the second member.

36. A socket connector configured to mount to a component comprising:

a first member having opposite ends, a first passageway extending between the opposite ends, and a channel extending outwardly from the first passageway;

a second member including a wall having opposite ends, a second passageway extending between the opposite ends of the wall, and a flange extending outwardly from the wall, the wall being seated within the first passageway of the first member and the flange being seated within the channel of the first member, wherein the second member is configured for movement within the first member;

a first biasing member engaging a first side of the flange and surrounding the wall;

a second biasing member engaging a second, opposite side of the flange; and a contact seated within the second passageway of the second member.

37. The socket connector as defined in claim 36, wherein the first member is a base and wherein the second member is a barrel.

38. The socket connector as defined in claim 36, wherein the first biasing member is a wave spring.

39. The socket connector as defined in claim 36, wherein the second biasing member is a wave spring.

40. The socket connector as defined in claim 36, wherein each of the first and second biasing members is a wave spring.

41. The socket connector as defined in claim 36, wherein the first biasing member is engaged between the first side of the flange and the first member, and wherein the second biasing member is engaged between the second side of the flange and the first member.

42. The socket connector as defined in claim 36, further comprising a cap attached to the contact and the second member.

43. The socket connector as defined in claim 36, wherein an outer surface of the first member is configured to engage a wall forming a through-hole of the component.

44. The socket connector as defined in claim 43, wherein the outer surface of the first member is serrated.

45. A socket connector comprising:

a first member which is at least partially formed of a conductive material, the first member being configured to be mounted to a first electrical component, the first member having a generally cylindrical shape, the first member having a cross-section defined by an outer wall having an upper end and a lower end, an upper side wall extending from the upper end, a lower side wall extending from the lower end, a free end of each of the upper and lower side walls defining upper and lower openings, respectively, of the first member, the upper and lower openings defining a first passageway therebetween;

a second member which is at least partially formed of a conductive material, the second member being configured to be mounted to a second electrical component, the second member having an outer wall and a flange extending outwardly therefrom, the flange being configured for movement between the upper and lower side walls of the first member, the outer wall having an upper end and a lower end, at least one of the upper end and the lower end of the outer wall extending beyond the respective upper end and lower end of the first member, the second member having a second passageway which extends therethrough; and a third member which is at least partially formed of a conductive material, the third member being positioned between, and configured to be in contact with both of, the flange and one of the upper and lower side walls of the first member.

46. A socket connector comprising:

a first member which is at least partially formed of a conductive material, the first member being configured to be mounted to a first electrical component, the first member having first and second opposite ends, the first member defining a first passageway which extends therethrough, a channel positioned between the first and second ends, the channel being open to the first passageway and defining an inner diameter of the first member;

a second member which is at least partially formed of a conductive material, the second member being configured to receive a second electrical component, the second member having a flange, the flange being configured for movement within the channel, the second member having first and second opposite ends, the second member defining a second passageway which extends therethrough; and a third member which is at least partially formed of a conductive material, the third member being positioned within the channel between the first member and the flange, the third member configured to be in contact with both the first member and the flange, the third member having an outer diameter, wherein the inner diameter of the first member and the outer diameter of the third member are substantially the same.

47. A socket connector configured to mount to a component, the socket connector comprising:

a base having opposite ends, a passageway extending between the opposite ends, and a channel extending outwardly from the passageway;

a barrel including a wall having opposite ends, a passageway extending between the opposite ends of the wall, and a flange extending outwardly from the wall, the wall being seated within the passageway of the base and the flange being seated within the channel of the base, wherein the barrel is configured for movement within the base;

a biasing member engaging the flange and surrounding the wall; and a contact seated within the passageway of the barrel, wherein the barrel has first and second opposite ends, at least one of the first and second opposite ends of the barrel protruding outwardly relative to an outer surface of the base, the passageway extending through the first and second opposite ends of the barrel.

48. A socket connector configured to mount to a component comprising:

a base having opposite ends, a first passageway extending between the opposite ends, and a channel extending outwardly from the first passageway;

a barrel including a wall having opposite ends, a second passageway extending between the opposite ends of the wall, and a flange extending outwardly from the wall, the wall being seated within the first passageway of the base and the flange being seated within the channel of the base, wherein the barrel is configured for movement within the base;

a first biasing member engaging a first side of the flange and surrounding the wall; and a second biasing member engaging a second, opposite side of the flange, wherein an outer surface of the base is configured to engage a wall forming a through-hole of the component, and wherein the outer surface of the base is serrated.

49. The socket connector as defined in claim 48, further comprising a lip extending outwardly from the outer surface of the base.

50. The socket connector as defined in claim 48, further comprising a contact seated within the second passageway of the barrel.

51. The socket connector as defined in claim 50, further comprising a cap attached to the contact and the barrel.

52. The socket connector as defined in claim 51, wherein the cap comprises a first annular wall which defines a central passageway, a second wall extending radially outwardly from and perpendicular to the first annular wall of the cap, and a third annular wall extending from and perpendicular to the second wall of the cap and parallel to the first annular wall of the cap.

* * * * *